United States Patent [19]

Vance

[11] Patent Number: 4,720,053

[45] Date of Patent: Jan. 19, 1988

[54] HOLDER FOR A ROLL OF PAPER TOWELS

[76] Inventor: Robert F. Vance, P.O. Box 1174, Tulsa, Okla. 74101

[21] Appl. No.: 910,555

[22] Filed: Sep. 23, 1986

[51] Int. Cl.[4] ..... B65H 19/00; B65H 35/00

[52] U.S. Cl. ..... 242/55.54; 225/79

[58] Field of Search ..... 242/55.2, 55.42, 55.53, 242/55.54; 225/77, 79, 82, 90; 206/53, 54, 397, 408; D6/518, 521, 522, 523

[56] References Cited

U.S. PATENT DOCUMENTS

| | | | |
|---|---|---|---|
| 846,194 | 3/1907 | Finan | 225/82 |
| 2,944,749 | 7/1960 | Maier | 242/55.2 |
| 3,843,071 | 10/1974 | Graham | 242/55.53 |
| 4,030,676 | 6/1977 | Bardsley | 242/55.54 |
| 4,369,929 | 1/1983 | Cayer | 242/55.54 X |
| 4,487,376 | 12/1984 | Compton | 242/55.54 |

FOREIGN PATENT DOCUMENTS

| | | | |
|---|---|---|---|
| 285769 | 2/1928 | United Kingdom | 242/55.54 |

*Primary Examiner*—David Werner
*Attorney, Agent, or Firm*—Edwin E. Greigg

[57] ABSTRACT

A holder for a roll of paper which has a base shaped to prevent tipping over and which is provided with an upstanding pole for holding a roll of paper in place between a cap and the base, upstanding parallel spaced guides guide the sheets of paper for removal and impeding material is placed on the base and pole to impede removal of the sheets.

5 Claims, 4 Drawing Figures

HOLDER FOR A ROLL OF PAPER TOWELS

BACKGROUND OF THE INVENTION

This invention is directed to a device for holding a roll of paper towels and more particularly to a device which supports a roll of paper towels in an upright position with the roll perpendicular to the base of the holder and with the base on a horizontal surface.

It is known in the prior art to support rolls of paper towels on walls, under sinks, under cabinets, etc. U.S. Pats. Nos. 4,030,676 and 4,487,376 are examples of paper towel holders which are supported by a base on a horizontal surface. These towel holders are not stable and readily tip over unless held in place during removal of a paper towel sheet.

It is therefore an object of this invention to provide a towel holder which has a paper guide which is used to tear off towel sheets.

Another object is to provide a towel holder that will not tip over during removal of a sheet of towelling.

Still another object is to provide a towel holder which will apply a retarding force on the roll of paper to impede unrolling the paper sheets to be torn off.

These and other objects and advantages of the invention will become apparent from a reading of the following description in view of the following drawings, in which.

DETAILED DESCRIPTION

Figure 1:
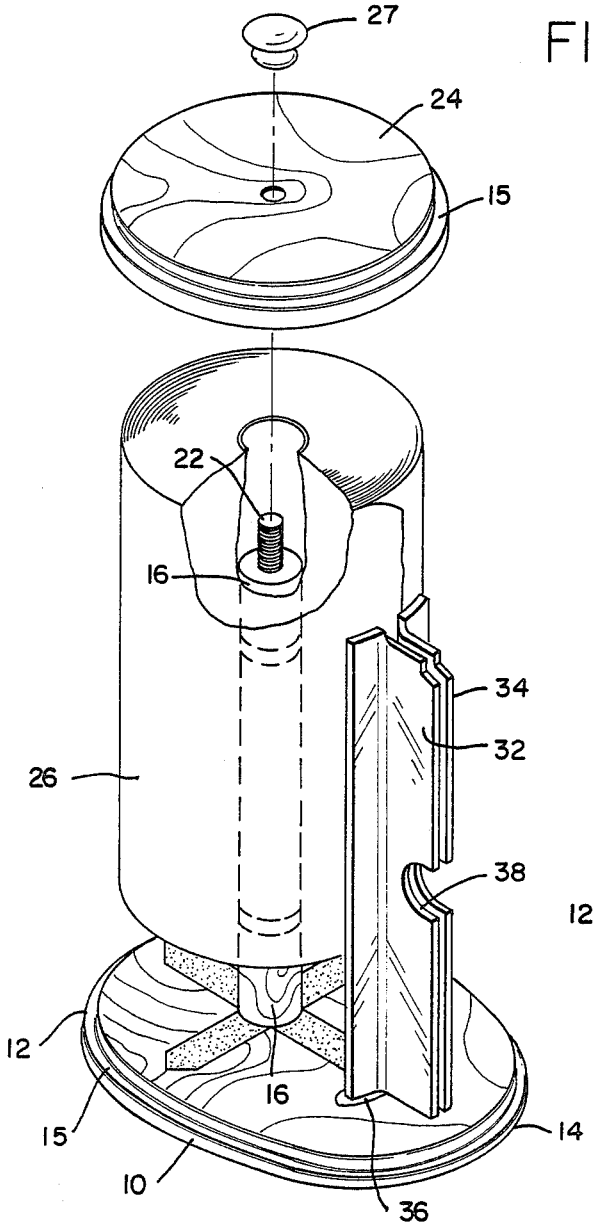
FIG. 1 is an exploded perspective view partially cut-away to show different features.
Figure 2:
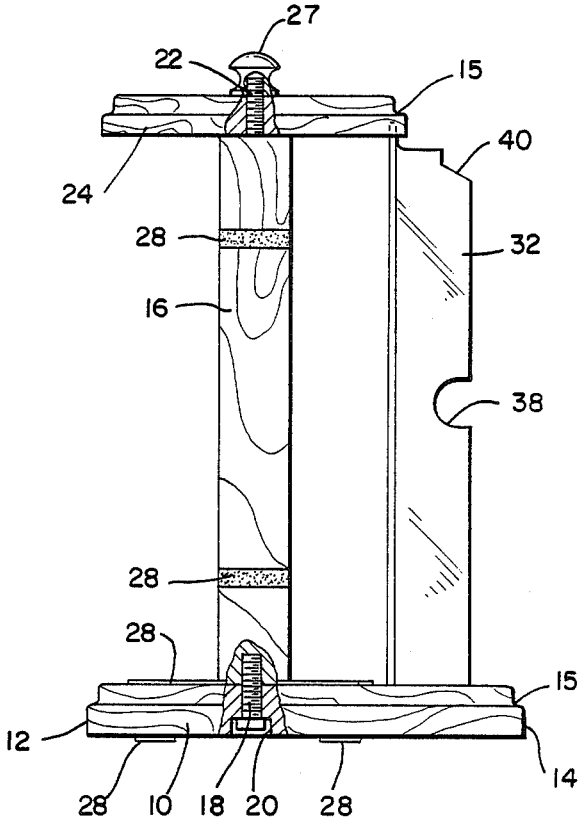
FIG. 2 is a side view partially cut-away to illustrate certain features.
Figure 3:
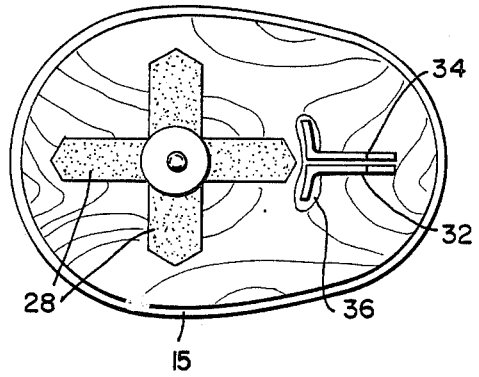
FIGS. 3 and 4 illustrate the base and cap, respectively.
Figure 4:
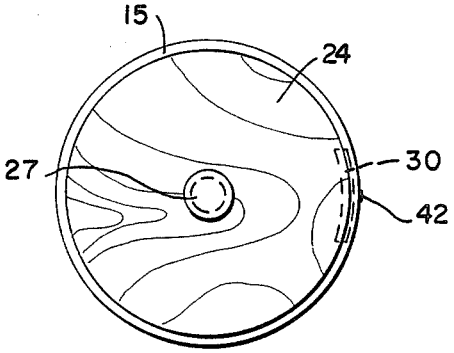

Now referring to the drawing, there is shown a free standing portable paper towel holder including a pedestal base 10 having a length which is greater than its width. The base is shown with a circular portion 12 joined with an elliptical portion 14 centered on its long axis. The circular portion and elliptical portion join along their outer surfaces in a smooth continuous surface. The base can be provided with an upper cutaway groove 15 for decorative purposes. An upstanding pole 16 is centered on the circular end portion and secured to the base by any suitable means such as a lag screw 18 which fits through an aperture in the base for threading into the pole along its linear axis. An inset hole 20 in the bottom of the base receives the head of the lag screw. A suitable glue may also be used between the end of the pole and the upper surface of the base for additional support. The upper end of the pole is provided with a threaded bolt 22 which screws into the end along its axis and which extends upwardly from the end, upon which a circular upper end 24 or cap is secured onto the pole above a roll of paper 26 by a knob 27. The cap may be provided with a groove 15 along its upper edge such as to match the groove in the base.

The upper and lower surfaces of the base may be provided with a material 28 such as plastic, rubber or any other suitable materials which will impede rotation of the paper towel roll. Also, the upright pole 16 may have a like material 28 on portions of its surface for assisting in impeding the rotation of the paper towel roll 26 during removal of each sheet.

The upper end or cap 24 is provided with an arcuate groove 30 near its outer surface which receives the upper end of parallel spaced guides 32 and 34, which are secured at the bottom in an arcuate groove 36 in the upper surface of the base on the same plane as the groove in the cap. The bottoms of the guides are secured in place by use of a suitable glue or any other suitable means. The parallel spaced guides 32 and 34 are provided with end extensions that extend into the arcuate grooves 30 and 36 and also have a central cut-out 38 along its length by which a sheet of paper towelling can be grasped. The upper edge of the spaced guide is also cut down at 40 for the purpose of grasping the upper edge of a sheet of paper towelling in order to feed the first sheet through the guide. The cap is provided with a colored dot 42 or indecia means on its outer surface opposite the center of the arcuate groove in order to indicate where the groove is located for installing the cap onto the guides. The knob 27 is threaded onto the bolt 22 in order to hold the cap 24 in place.

On assembling the paper towel holder, the roll impeding material is secured to the upper and lower surfaces of the base outwardly from the pole in the area that receives a full roll of towels. The arcuate groove in the base is formed centered on the long axis toward the elliptical end. The pole 16 with the bolt 22 screwed in its upper end is secured in place onto the base by the lag bolt and then the parallel spaced guides are secured at their lower end to the arcuate groove in the base. The roll of paper towels can now be placed onto the pole and the first towel sheet fed between the parallel guides. The upper end may be pulled through at the cut-down edge 40 and the whole first sheet may be pulled through. The cap is then installed with the upper end of the guides in the arcuate groove of the cap. The knob is then screwed in place and the roll of paper is ready for use. Since the base is made with a long axis and the paper is pulled along this axis, the holder will not tip over during use.

The arcuate groove in the cap could be provided with a divider at its center which would then hold the guides apart to insure that a slot is between the guides.

In operation, the roll of paper towels are placed over the upright pole and the upper corner of the first sheet of towelling is pulled through the spacing between the guides at the top of the guides then the sheet is pulled until the whole width of the sheet passes through the spacing. The cap is placed on the pole and the knob is threaded onto the bolt.

The roll-impeding material on the upper surface of the base and on the pole impedes the unrolling of the sheets of towelling as they are pulled through the guides. The guides have a smooth outer edge except for the central cut-away so that the edge can be used for tearing a sheet from the roll. The impeding material on the bottom surface of the base prevents the portable holder from sliding on the supporting horizontal surface.

It will be obvious to anyone that any suitable material may be used for the various parts of the holder, such as wood or plastics.

What is claimed and desired to be secured by Letters Patent of the United States is:

1. A free standing portable holder for supporting conventional rolls of paper towelling which may be rolled on a hollow core center and means for facilitating gradual tearing off a sheet of paper towel from said roll by manually gripping a perpendicularly disposed edge of said paper towelling comprising, a pedestal base adapted to rest upon a horizontal surface, said pedestal base including upper and lower surfaces, separate parallel adjacent closely spaced sheet guide means extending upwardly from said upper surface of said base, each of said upstanding sheet guide means have oppositely disposed horizontally aligned arcuate cut-away portions to facilitate grasping of said paper towelling which is guided between said sheet guide means, said upper, pedestal surface including an arcuate slotted depression adapted to receive bottom extremities of said upstanding adjacent closely spaced parallel disposed sheet guide means, a pole secured to the upper surface of said base, said pole having a length greater than said hollow core extending upwardly from said base and having a diameter adapted to fit within the hollow core of said roll of paper towelling for supporting the latter with its axis normal to the upper surface of said base; a threaded bolt having a diameter less than said pole secured to the top of said pole along a linear axis, a cap which is free of any axially extending edge surface, said cap having an axial aperture greater than said bolt for positioning said cap on said threaded bolt and for seating on said upstanding pole, a knob having a diameter greater than said axial aperture in said cap which is screwed onto said threaded bolt to hold said cap in place, said cap including a lower surface zone provided with an arcuate undercut depression which is arranged to receive the upper extremities of said upstanding sheet guide means, said arcuate undercut depression in said cap and said upper surface of said base being spaced from said pole so that said guide means stands outwardly of an unused roll of towelling when placed in said holder, said free standing portable holder further includes paper towel roll impeding friction creating means spacedly arranged on the circumference of said upwardly extending pole and on the upper and lower surfaces of said base, said impeding means on the upper surface of said base having an outer zone deliminated by the circumference of an unused roll of towelling placed on said pole.

2. A free standing portable holder for paper towelling as claimed in claim 1 in which said pedestal base is longer along one axis and has a circular shaped portion on one end with an elliptical shaped portion on the opposite end centered on its long axis with said circular shaped portion and said elliptical shaped portion meeting with a smooth continuous outer surface.

3. A free standing portable holder as claimed in claim 1 in which said arcuate slotted zone in said base and said arcuate slotted zone in said cap are centered on the spacing between said parallel spaced sheet guide means.

4. A free standing portable holder as claimed in claim 3 in which said arcuate slotted zone in said base is centered on its long axis.

5. A free standing portable holder as claimed in claim 1 in which an indecia means is disposed on said annular rim of said cap medially of said under-cut depression in said cap in order to align said cap with the upper extremities of said guide means.

* * * * *